United States Patent [19]

Snyder

[11] 4,003,698

[45] Jan. 18, 1977

[54] PRODUCT AND METHOD OF PRINTING CARPET

[75] Inventor: Robert W. Snyder, Lancaster, Pa.

[73] Assignee: Armstrong Cork Company, Lancaster, Pa.

[22] Filed: Sept. 12, 1975

[21] Appl. No.: 612,907

[52] U.S. Cl. ..... 8/1 XB; 8/2.5 R; 8/2.5 A

[51] Int. Cl.[2] ..... D06P 1/00

[58] Field of Search ..... 8/2.5 R, 2.5 A, 1 XB

[56] References Cited

UNITED STATES PATENTS 3,782,896 1/1974 Defago et al. ..... 8/2.5

FOREIGN PATENTS OR APPLICATIONS 1,189,026 4/1970 United Kingdom ..... 8/2.5

OTHER PUBLICATIONS

British Knitting Industry Journal, Transfer Prints 1973, Vellin.

*Primary Examiner*—John Kight, III

[57] ABSTRACT

A pattern is placed on a carpet backing by the use of sublimable dyes. Carpet facing is tufted into the backing. Subsequent heating causes the sublimable dye to move from the carpet backing to the face yarn to provide the dyed pattern on the face yarn.

6 Claims, 2 Drawing Figures

PRODUCT AND METHOD OF PRINTING CARPET

BACKGROUND OF THE INVENTION

1. Field of the Invention

The invention is primarily directed to a technique for printing carpet, and more particularly, to a printing technique that uses sublimable dyes and uses the carpet backing as the transfer carrier for the sublimable dyes.

2. Description of the Prior Art

U.S. Pat. No. 3,782,896 discloses it is old to use transfer printing operations to print carpet designs.

Transfer printing through the use of sublimable dyes is an old art. Normally the dye is carried on a transfer carrier or sheet and the transfer carrier is placed up against the surface to be dyed. Through the use of heat and pressure, the sublimable dyes are converted to a vapor stage and transferred to the surface of a material adjacent the transfer carrier. The transfer carrier is then usually discarded. When one would attempt to transfer print heavy fabrics, such as carpet, then vacuum action would be required to attempt to secure some dye penetration into the fabric.

The inventive technique herein is the utilization of the transfer carrier as a portion of the finished product. Herein, specifically, the transfer carrier is used as the conventional backing for a carpet product and has tufted thereinto the face carpet yarns which will be subsequently dyed by the sublimable dyes on the transfer carrier.

SUMMARY OF THE INVENTION

A conventional carpet backing is provided with a pattern printed thereon through the use of inks containing sublimable dyes. After the inks have had an opportunity to dry, conventional yarn is tufted into the carpet backing to form the ultimate carpet product composed of a backing and a tufted face yarn. Heated air is then passed through the carpet in the direction from the backing to the face yarn. This causes the sublimable dyes to change to a vapor phase and be transferred from the carpet backing to the carpet face yarn. There then results a product which is composed of a carpet backing and face fiber yarns containing a decorative pattern thereon.

DESCRIPTION OF THE PREFERRED EMBODIMENT

The process herein is carried out by basically the following steps. A conventional carpet backing or scrim material, which preferably is porous in nature, is provided with a design printed thereon by a conventional Zimmer printer, utilizing inks containing sublimable dyes. Printing can be carried out by any commercially available printer as long as it places the different inks in position in register. The printed carpet backing is then permitted to air dry. A conventional carpet yarn is tufted into the carpet backing by conventional tufting machinery. The pile or loops or face fiber yarns of the finished tufted yarn product will be preferably on the same side of the carpet backing as was the printed design containing sublimable dyes. The carpet backing with the tufted yarns is then subjected to either heat alone or preferably a heated air treatment wherein air is passed through the carpet in the direction from the backing of the carpet through to the face fiber yarn of the carpet. At this time, the pattern printed on the carpet backing is transferred from the carpet backing and fully developed throughout the height of the pile of the face yarns. There is then provided a carpet product which has a backing and yarn tufted into the face thereof with the yarn being dyed in a selected pattern. The use of directional heated air improves pattern definition and depth of dye penetration into the pile of the carpet.

Figure 1:
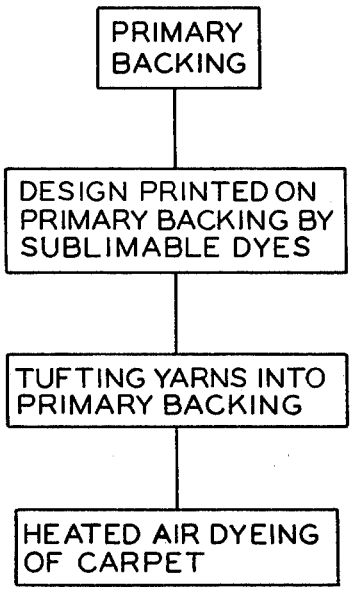
FIG. 1 is a schematic drawing of the process herein.
Figure 2:
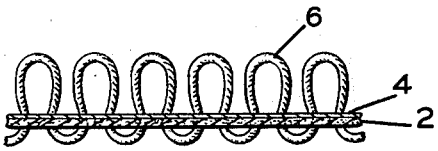
FIG. 2 is a cross sectional view of the product of the invention herein.

In one specific example of the invention, conventional jute carpet backing with a 19 × 19 count is utilized. The 19 × 19 count is the number of yarns in the warp and woof direction. The aforesaid jute weighs approximately 6 ounces per square yard (203 g. per square meter). This material is run across a Zimmer printer and printed with conventional inks containing sublimable dyes. Specifically, the dyes being used are Latyl Cerise NSN, C.I. Disperse No. Red 60, C.I. Constitution No. 60756; Latyl Violet 2R, C.I. Disperse No. Violet 28, C.I. Constitution No. 61102; and Acetamine Yellow CG, C.I. Disperse No. Yellow 3, C.I. Constitution No. 11855. The design printed on the jute may be any type of aesthetic design and after it is printed on the jute with the abovesaid sublimable dyes, it is permitted to dry. Nylon 66 yarn, Dupont Type 846, 1300 denier, bulked continuous filament is then tufted into the jute using a 5/64 gauge (0.2 cm), 12 tufts per inch to produce a ⅛ inch (0.3 cm) pile level looped carpet weighing 13 ounces per square yard (441 g. per square meter). This then yields a product similar to FIG. 2 wherein the carpet scrim 2 is provided with a design 4 and tufted yarn 6. The tufted yarns have their pile looped construction on the side of the carpet backing 2, which is the same side of the carpet backing 2 which has the printed design 4.

The above product is then passed through a chamber wherein air, at 425° F. (218° C.), may be passed through the carpet in the direction from the scrim 2 to the face yarn 6 at a rate of 15 standard cubic feet per minute per square foot (5 cubic meters per minute per square meter) for 90 seconds. In this time, the pattern 4 which was printed on the jute with sublimable dyes is transferred and fully developed throughout the height of the pile 6. The print is brightly colored with a soft diffused appearance.

In addition to using jute as the backing material, the invention has been carried out using backing materials of glass fiber and woven and non-woven polypropylene. In addition to using nylon 66 as the carpet face yarn, the invention can be carried out using nylon 6, acrylic, and polyester fibers as the carpet face yarn. The invention has been carried out without directional heated air with carpet backing having tufted thereinto face yarns of as high as 12 tufts per inch to produce a pile height of ⅛ inches (0.3 cm) with a carpet face weight up to 13 ounces per square yard (441 g. per square meter). If directional air is used, the transfer may be carried out with carpet face yarns as high as one inch (2.5 cm) in pile height with a carpet face weight up to 48 ounces per square yard (1.6 kg per square meter).

The invention has been carried out with a directional air flow rate of as low as 10 standard cubic feet per minute per square foot (3.0 cubic meters per minute per square meter) and as high as 120 standard cubic feet per minute per square foot (37 cubic meters per minute per square meter) for a carpet construction of a pile height of 1 inch (2.5 cm) with a carpet face weight up to 48 ounces per square yard (1.6 kg per square meter). It would appear that the air flow upper limit is determined by output capability of the air moving means and the air flow rate is selected based upon the scrim material used, face fiber material used, dye used, operating temperature and desired production speed.

The invention need not be restricted to just the use of heated air to cause the sublimable dyes to transfer, but the invention can also be carried out through the use of superheated steam. Other gases could be utilized, and it would appear that the three primary purposes of the gas utilized is (1) to cause the dye to change to a vapor phase, (2) to move the vapor phase dye through the carpet face yarn from the backing to the front of the carpet facing, and (3) to facilitate diffusion of the dye into the fiber.

Successful transfer printing has been carried out with temperatures as low as 260°–270° F. (127°–132° C.) for the heated air. This has required printing times of from 7 to 15 minutes with a dye such as Celanthrene Blue FFS, C.I. Disperse No. Blue 3, C.I. Constitution No. 61505. Since sublimable dyes tend to sublime at different temperatures, it is obvious that the temperature used is primarily a function of the dye being utilized.

Three primary dyes have been utilized for most work to date. These dyes are primarily disperse dyes and may be mixed to produce other colors such as are listed in the table below. These three dyes transfer at similar rates.

Table 1

| Trade Name | Latyl Cerise NSN | Latyl Yellow 3G | Calanthrene Brilliant Blue FFS |
|---|---|---|---|
| C.I. Disperse No. | Red 60 | Yellow 54 | Blue 3 |
| C.I. Constitution No. | 60756 | 47020 | 61505 |
| Color | Relative Proportion in Printing Ink | | |
| Red | 100% | | |
| Red-orange | 50 | 50 | |
| Orange | 25 | 75 | |
| Yellow-orange | 10 | 90 | |
| Yellow | | 100 | |
| Yellow-green | | 90 | 10 |
| Green | | 25 | 75 |
| Blue-green | | 50 | 50 |
| Blue | | | 100 |
| Indigo | 25 | | 75 |
| Violet | 50 | | 50 |
| Red Violet | 90 | | 10 |

The invention herein need not be restricted to the dyes above listed, but may be utilized with the following dyes: C.I. Disperse No. Yellow 3, C.I. Constitution No. 11855; C.I. Disperse No. Yellow 64, C.I. Constitution No. 47023; C.I. Disperse No. Blue 7, C.I. Constitution No. 62500; C.I. Disperse No. Blue 56, C.I. Constitution No. 63285; C.I. Disperse No. Violet 28, C.I. Constitution No. 61102, etc. It is also possible to use solvent dyes such as C.I. Solvent Yellow 77, C.I. Constitution No. 11855; C.I. Solvent Yellow 16, C.I. Constitution No. 12700; and C.I. Solvent Blue 68, C.I. Constitution No. 61110. The invention is also workable with dyes such as C.I. Vat Violet 15, C.I. Constitution No. 63355; C.I. Vat Yellow 26, C.I. Constitution No. 65410 and acid dye Yellow 54, C.I. Constitution No. 47020.

The inks which normally are used for the printing of the backing are prepared as a three-part composition. A thickener is used and it will constitute 80–90 parts by weight of the mix. The disperse dye will constitute 5 to 10 parts of the mix and an accelerator will constitute 0 to 10 parts of the mix. The thickener usually consists of a 3% Chemloid 2245 in water plus 0.1% Dowicide G as preservative. Chemloid 2245 is supplied by the Chemloid Company and is basically a refined natural ether or gum. Dowicide G is produced by the Dow Chemical Company and is basically a monohydrate of sodium pentachlorophenate. The ink is prepared by dissolving the preservative in water, then slowly adding the Chemloid 2245 while using a high shear mixer to mix. The mix is allowed to stand 2 to 4 hours before final mixing and use. If an accelerator is used, it is added and mixed using a high shear mixer. A typical accelerator that may be used is a polyvinylacetate emulsion. Finally, the disperse dye is added and mixed for 5 to 10 minutes to produce a uniform smooth ink. In the ink formulation, the amount of dye is varied depending upon the depth of color desired. The accelerators increase the intensity of color developed with a given amount of dye. Accelerators also have a tendency to reduce the time required to produce a print with a given intensity. Other typical examples of carpeting which have been made by the above process are as follows:

In another example of the invention, conventional woven glass scrim primary carpet backing with a 39 × 28 count is utilized. The 39 × 28 count is the number of yarns in the warp and woof direction. The aforesaid glass scrim weighs approximately 6.3 ounces per square yard (214 g. per square meter). This material is run across a Zimmer printer and printed with conventional inks containing sublimable dyes. Specifically, the dyes being used are Latyl Cerise NSN, C.I. Disperse No. Red 60, C.I. Constitution No. 60756; Latyl Violet 2R, C.I. Disperse No. Violet 28, C.I. Constitution No. 61102; and Acetamine Yellow CG, C.I. Disperse No. Yellow 3, C.I. Constitution No. 11855. The design printed on the glass scrim may be any type of aesthetic design and after it is printed on the glass scrim with the abovesaid sublimable dyes, it is permitted to dry. Nylon 66 yarn, Dupont Type 846, 1300 denier, bulked continuous filament is then tufted into the jute using a 5/64 (0.2 cm) gauge, 12 tufts per inch to produce a ⅛ inch (0.3 cm) pile level looped carpet weighing 13 ounces per square yard (441 g. per square meter). This then yields a product similar to FIG. 2 wherein the carpet scrim 2 is provided with a design 4 and tufted yarn 6. The tufted yarns have their pile looped construction on the side of the carpet backing 2, which is the same side of the carpet backing 2 which has the printed design 4.

The above product is then passed through a chamber wherein air, at 425° F. (218° C.), may be passed through the carpet in the direction from the scrim 2 to the face yarn 6 at a rate of 15 standard cubic feet per minute per square foot (5 cubic meters per minute per square meter) for 2 minutes. In this time, the pattern 4 which was printed on the glass scrim with sublimable dyes is transferred and fully developed throughout the height of the pile 6. The print is brightly colored with a soft diffused appearance.

In another example of the invention, conventional woven polypropylene scrim primary carpet backing with a 24 × 11 count is utilized. The 24 × 11 count is the number of yarns in the warp and woof direction. The aforesaid polypropylene scrim weighs approximately 3 ounces per square yard (101 g. per square meter). This material is run across a Zimmer printer and printed with conventional inks containing sublimable dyes. Specifically, the dyes being used are Latyl Cerise NSN, C.I. Disperse No. Red 60, C.I. Constitution No. 60756; Latyl Violet 2R, C.I. Disperse No. Violet 28, C.I. Constitution No. 61102; and Acetamine Yellow CG, C.I. Disperse No. Yellow 3, C.I. Constitution No. 11855. The design printed on the polypropylene may be any type of aesthetic design and after it is printed on the polypropylene with the abovesaid sublimable dyes, it is permitted to dry. Nylon 66 yarn, Dupont Type 846, 1300 denier, bulked continuous filament is then tufted into the jute using a 5/64 (0.2 cm) gauge, 12 tufts per inch to produce a ⅛ inch (0.3 cm) pile level loop carpet weighing 13 ounces per square yard (441 g. per square meter). This then yields a product similar to FIG. 2 wherein the carpet scrim is provided with a design 4 and tufted yarn 6. The tufted yarns have their pile looped construction on the side of the carpet backing 2, which is the same side of the carpet backing 2 which has the printed design 4.

The above product is then placed in an oven wherein the air in the oven is heated to 435° F. (224° C.). No air flow through the carpet is specifically caused by a mechanical means driving the air through the carpet. The heat within the carpet will cause the sublimation of the dye and the dye vapor will rise up and pass through the carpet face yarn which is setting on the upper side of the product as it sets within the oven. The product is kept in the oven for 2 minutes. In this time, the pattern 4 which was printed on the polypropylene scrim with the sublimable dyes is transferred and fully developed throughout the height of the pile 6. The print is brightly colored with a soft diffused appearance. The appearance will not be as well defined as the appearance which will be secured should an air flow be directed through the carpet from the carpet scrim through the face yarn of the carpet.

Based upon experimentation to date, it is believed that through the use of the above described different scrims, carpet face fibers and disperse dyes, it is possible to make a product through the use of an air flow rate as low as about 10 standard cubic feet per minute per square foot (3.0 cubic meters per minute per square meter), and preferably 10–120 standard cubic feet per minute per square foot (3.0–37 cubic meters per minute per square meter). The transfer may be carried out through the use of different gaseous mediums which may be heated anywhere in the range of about 260° F. to 450° F. (127° C.–232° C.), primarily depending upon the disperse dyes being utilized and the sensitivity of the carpet components to temperature. The time for transfer of the dye may take anywhere from about 30 seconds to 15 minutes, but should preferably occur within a 30-second to 3-minute time span.

What is claimed is:

1. A process for making a decorative carpet through the use of sublimable dyes comprising the steps of:

a. printing sublimable dyes on the carpet backing prior to the time the carpet face yarns are tufted into the carpet backing, b. tufting the carpet face yarn into the carpet backing with the carpet face yarn pile being on the side of the carpet backing which contains the sublimable dyes, and then c. transferring the sublimable dyes from the carpet backing to the carpet face yarn through the application of a heated gaseous medium passing through the carpet product from the carpet backing side of the carpet to the carpet face yarn side of the carpet.

2. The process according to claim 1 wherein the gaseous medium is supplied at an air flow rate as low as 10 standard cubic feet per minute per square yard, and ranging from preferably about 10 to 120 standard cubic feet per minute per square foot.

3. The process according to claim 1 wherein the gaseous medium is supplied at a temperature ranging from about 260° F. to 450° F. and dye transfer time ranges from about 30 seconds to 15 minutes.

4. A product made according to the process of claim 1.

5. A process for making a decorative carpet through the use of sublimable dyes comprising the steps of:

a. printing sublimable dyes on the carpet backing prior to the time the carpet face yarns are tufted into the carpet backing, b. tufting the carpet face yarn into the carpet backing with the carpet face yarn pile being on the side of the carpet backing which contains the sublimable dyes, and then c. transferring the sublimable dyes from the carpet backing to the carpet face yarn through the application of heat to the carpet to vaporize the dyes and permit the dyes to transfer to the carpet face yarn.

6. A product made according to the process of claim 5.

* * * * *